US005988283A

United States Patent [19]

Gann

[11] Patent Number: 5,988,283

[45] Date of Patent: Nov. 23, 1999

[54] VERTICAL COMBINED PRODUCTION FACILITY

[75] Inventor: Don Mike Gann, Keller, Tex.

[73] Assignee: Union Pacific Resources Company, Fort Worth, Tex.

[21] Appl. No.: 08/887,177

[22] Filed: Jul. 2, 1997

[51] Int. Cl.[6] ..... E21B 43/34

[52] U.S. Cl. ..... 166/357; 95/193; 95/231; 95/253; 96/183; 96/185; 96/186; 166/267; 210/747; 210/774; 210/776; 210/787; 210/802; 210/804; 210/806; 210/170; 210/180; 210/181; 210/182; 210/188; 210/260; 210/262; 210/294; 210/DIG. 5

[58] Field of Search ..... 95/253, 193, 231; 96/183, 185, 186; 166/267, 357; 210/787, 799, 802, 806, 180, 181, 182, 188, 260, 261, 262, 294, 295, 521, 522, DIG. 5, 747, 774, 776, 804, 170, 242.1

[56] References Cited

U.S. PATENT DOCUMENTS

| | | | |
|---|---|---|---|
| 2,528,032 | 10/1950 | Candler et al. | 183/2.7 |
| 2,995,202 | 8/1961 | Glasgow | 96/186 |
| 3,043,073 | 7/1962 | Walker et al. | 55/45 |
| 3,094,574 | 6/1963 | Glasgow | 261/23 |
| 3,881,549 | 5/1975 | Thomas | 166/5 |
| 4,017,275 | 4/1977 | Hodgson et al. | 55/177 |
| 4,115,084 | 9/1978 | Coggins | 55/176 |
| 4,424,068 | 1/1984 | McMillan | 55/38 |
| 4,506,735 | 3/1985 | Chaudot | 166/357 |
| 4,643,834 | 2/1987 | Batutis | 210/740 |
| 4,685,833 | 8/1987 | Iwamoto | 405/195 |
| 4,793,418 | 12/1988 | Wheeler et al. | 166/357 |
| 4,848,475 | 7/1989 | Dean et al. | 166/357 |
| 4,900,433 | 2/1990 | Dean et al. | 210/170 |
| 5,474,601 | 12/1995 | Choi | 96/182 |
| 5,656,173 | 8/1997 | Jordon et al. | 210/703 |
| 5,665,144 | 9/1997 | Hill et al. | 96/185 |

FOREIGN PATENT DOCUMENTS

| | | |
|---|---|---|
| 8101310 | 5/1981 | WIPO . |

*Primary Examiner*—Peter A. Hruskoci
*Attorney, Agent, or Firm*—Fulbright & Jaworski L.L.P.

[57] ABSTRACT

A Vertical Combined Production Facility, or gas-well production system, in which the separation of each phase (hydrocarbon gas, hydrocarbon liquids, and produced water), dehydration of natural gas, removal of minute traces of water from the hydrocarbon liquids, and polishing of produced water, are performed in a single pressure vessel. Additionally, the pressure vessel is installed in a vertical configuration such that the pressure vessel shell also serves as the structural support for a small deck and helideck. Additionally, the inlet heating of the well flow-stream is accomplished by a heat exchanger installed in the dehydration/regeneration heater (reboiler).

51 Claims, 3 Drawing Sheets

VERTICAL COMBINED PRODUCTION FACILITY

BACKGROUND OF THE INVENTION

1. Technical Field of This Invention

The present invention relates to an offshore or marshland production system for use in the production of natural gas and hydrocarbon liquids.

2. The Prior Art

Currently, offshore and marshland production systems are comprised of numerous separate equipment components to perform specific functions. For example, indirect fired flow-line heaters are used to heat the flow-stream from a gas well to prevent freezing and formation of hydrates. Production separators separate the gas from condensate and produced water. Likewise, a coalescer is used to remove trace amounts of water from the condensate to satisfy market specifications and a water skimmer is used to polish produced water by removing trace amounts of hydrocarbon prior to disposing the water.

These separate components and the process function that each performs are typically installed on top of a structural steel deck and the separate components are interconnected with piping. To protect against upset conditions such as over-pressure or high liquid level, each component is equipped with safety devices such as high pressure shut-down sensors, pressure safety relief valves, and high/low liquid level shutdown sensors, etc.

Reference is made to U.S. Pat. No. 3,881,549, Production and Flare Caisson System. The Production and Flare Caisson System incorporates a vertical structural caisson into which a production separator is placed. The Production and Flare Caisson System is of limited benefit because only the production separator is placed in a vertical configuration, while the other process equipment is apparently mounted in a conventional manner on the structural deck. Utilizing these multiple components indicates the need for safety devices, such as high pressure shutdown switches, pressure safety relief valves, and high/low liquid level shutdown switches to be placed on each component and the need for these components to be interconnected with significant amounts of piping and instrumentation. Similarly, the Production and Flare Caisson System is limited in its ability to reduce the size of the structural deck, since components other than the production separator must be mounted on the structural deck. Further, the Production and Flare Caisson System makes no mention of additional value-added capabilities, such as dehydration of the gas, inlet heating of the flow-stream, polishing of the produced water or treatment of the liquid condensate.

Reference is now made to U.S. Pat. No. 4,848,475, Sea Bed Process Complex which describes a modularized oil well production complex for installation on the sea bed, which is intended to produce crude oil from oil wells. The Sea Bed Process Complex places each component into a separate "module" to facilitate installation and retrieval with sub-sea remote operated vehicles (ROV). Further, the Sea Bed Process Complex incorporates a two phase oil/gas separator utilizing a vertical annual separator in which an integral pump creates a centrifugal fluid movement which facilitates separation of the liquid and gas phases. Additionally, no mention is made in the patent for the Sea Bed Process Complex relating to dehydration of gas, heating of well-stream fluids, or polishing of produced water, which are fully described and provided for in my invention.

Reference is now made to U.S. Pat. No. 4,900,433, Vertical Oil Separator which describes a vertical separator for separating crude oil into liquid and gas phases. This patent discloses a separator which utilizes a casing design and vertical pump to impart a centrifugal or "swirling" action to flow-stream liquids, with the result that the liquid phase and gas phase of the flow-stream are separated. The Vertical Oil Separator does not accomplish heating of the inlet flow-stream, dehydration of the gas, condensate coalescing or water polishing. Further, the vessel of the Vertical Oil Separator is designed for installation below water at the sea bed and is not used as a structural component.

Reference is now made to U.S. Pat. No. 5,474,601, Integrated Floating Platform Vertical Annual Separator and Pumping System for Production of Hydrocarbons. This invention is an improvement on U.S. Pat. No. 4,900,433, in that the earlier patented device is modified and adapted for installation on a floating platform such as a tension leg platform. In addition, Patent No. 5,474,601 provides for a tensioned riser supported by a floating tension leg platform.

Reference is now made to U.S. Pat. No. 4,793,4180, Hydrocarbon Fluid Separation at an Offshore Site and Method. This invention discloses an apparatus and method for separating liquids from gas as received from large pipelines. Described in the text as a "slug catcher", the device eliminates intermittent slugs of liquids from the incoming flow-stream in order to facilitate downstream processing. This apparatus and method do not provide any capability to heat the incoming stream, separate produced water from natural gas liquids, dehydrate the natural gas, or further condition the natural gas liquids and produced water for sales or disposal, respectively. Neither is this device and method utilized as a structural component or combine the pressure vessel shell as a structural component; rather, it is installed into spare well conductor guides on existing platform structures.

Reference is now made to U.S. Pat. No. 4,506,735, Operating System for Increasing the Recovery of Fluids From a Deposit, Simplifying Production and Processing Installations, and Facilitating Operations with Enhanced Safety. This invention describes a sub-sea watertight hull configured to allow a production separator and other equipment components to be placed below the surface of the water in an atmospheric environment to facilitate production from very low pressure flow-streams by reducing hydrostatic pressures. This watertight hull allows many types of equipment components to be installed near the seabed without the disadvantages of hydrostatic pressure and inaccessibility of sub-sea installation. While the '735 patent mentions flow-stream heating, pumping, multiple stages of separation, large vessels for storage and secondary polishing, it clearly discloses these components as separate and distinct components.

Reference is made to U.S. Pat. No. 4,685,833, Offshore Structure for Deep-sea Production, which discloses an offshore structure consisting of a buoyant vessel containing a large separator for storing and separating produced fluids. The buoyant chamber provides protection for the separator, buoyancy support for the flow-lines and riser, as well as support for a deck. The '833 patent discloses a separator which is essentially a huge holding tank, with further processing being accomplished by conventional production equipment installed on top of a conventional deck. It is primarily designed for deep-water fields, taking advantage of the huge buoyant support to reduce or eliminate costly deep-water structures. The '833 patent does not disclose heating of the flow-stream, dehydration of gas, condensate coalescing or water polishing, nor does it describe a single vessel in which these functions are performed. Neither does this invention utilize the production process components as a structural support.

Reference is now made to WO 81/01310, Method and Column for Collection and Separation of Oil, Gas and Water From Blowing Wells at the Sea Bed, which discloses a method for collection of oil, gas and water from an offshore oil or gas well and a vertical column. This invention is designed to mitigate the effects of a catastrophic sub-sea well blowout by providing a means of controlling and collecting effluent discharged from the well. This invention does not address normal production functions such as gas dehydration, water polishing, condensate coalescing or well-stream heating, all of which are functions of my invention. While this invention does utilize the vessel as a structural component, the operating pressure is approximately the same as the hydrostatic head of water outside the column, rendering this device unusable for routine and continuous use as a production facility since all produced gas would have to be recompressed at high cost before flowing to gas pipelines.

SUMMARY OF THE INVENTION

One object of this invention is to combine the various process functions which comprise a typical hydrocarbon production facility, into a single unit. The systems combined in the present invention, which typically exist as separate units located at physically distinct locations within the production facility, are, for instance: a desiccant dehydration contactor, a separator, a coalescer, and a water skimmer.

A second object of this invention is to obviate the need for a separate heater to heat the hydrocarbon flow-stream mixture. As the mixture leaves the wellhead (the source) it is under significant pressure (e.g. 5000 psi). The pressure of the mixture must be substantially reduced for processing and sale of the gas and hydrocarbon liquids. Yet reducing the pressure causes the temperature to drop, and as the temperature of the mixture drops, hydrates may form in the mixture; in industry parlance, the mixture "freezes up," which inhibits processing of the mixture. To avoid hydrate formation, the mixture must be heated, hence the state-of-the art production facilities are outfitted with a flow-line heater for that purpose.

Such production facilities for the processing (separation) of hydrocarbon mixtures also generally include, for instance, a glycol regeneration unit. Glycol is used in the industry to remove water moisture from the natural gas, a required step prior to transporting the natural gas to market, once the latter has been substantially initially separated from the liquid hydrocarbon and the produced water. When hydrated natural gas is contacted with glycol, the glycol removes the moisture from the natural gas by absorption. Eventually, the glycol is completely hydrated, which means that it is no longer able to absorb additional water moisture from the natural gas. Hence, it must be regenerated. This is accomplished by heating the glycol above the boiling point of water to drive off the water by evaporation. Obviously, a heater is needed to accomplish this.

Traditionally, the glycol regeneration (which requires a heater), and heating the flow-stream mixture are done by separate components. The instant invention combines these two components. In other words, instead of a separate heater to heat the mixture so that it can be processed, a heat exchanger is used, which rather than generating heat, draws it directly from a liquid organic solvent or glycol reboiler.

The features of the present invention are as follows. The apparatus of this invention is essentially comprised of two components: the regeneration/heating unit, and the separation module. The regeneration/heating unit is comprised of the reboiler which heats the particular dehydration compound used to remove water from the natural gas, to remove the water so that the compound can be reused. Thermally engaged to this heater is a heat exchanger which ultimately delivers heat to the unprocessed mixture after it has undergone the significant pressure drop, hence is at a lower temperature relative to its temperature at the wellhead.

The second feature of the invention is the processing unit. The processing unit comprises all or virtually all of the functions needed to completely process the raw hydrocarbon mixture, i.e., separate it into its constituents so that the natural gas and liquid hydrocarbon can be delivered to market. Each of these systems and their various means of operation are well-known in the industry. These systems include: an initial separator which separates the liquid (liquid hydrocarbon and produced water) from the natural gas (usually by gravity), a contactor which removes moisture from the natural gas, a coalescer which removes entrained water globules from the liquid hydrocarbon, and a further water polishing unit which removes entrained hydrocarbon from the water so that it is suitable for discharge into the sea or ground.

The present invention achieves numerous advantages over the prior art. The combination of the primary processing systems into a single vessel is not merely a physical positioning of these elements, but an integration of the elements, with many consequential advantages. The benefits from combining traditionally distinct hydrocarbon processing functions units are: (1) reduction in the expense of manufacturing the processing unit since redundant safety devices are not needed for numerous components (rather, only a single set of devices are needed for the entire apparatus), and since significantly less interconnecting piping and valves are required in the instant invention; and since the vessel can be used as the primary support for a deck, thus eliminating the need for additional structural support which may be considerable particularly for offshore installation; (2) reduction of operating costs largely related to the above reasons; (3) the entire processing apparatus can be contained within a single vessel which can serve as the sole structural support for a deck; (4) reduction of installation costs of the entire facility since the size and weight of the structure are reduced; and (5) greater safety, since the number of separately fired devices is effectively reduced.

DETAILED DESCRIPTION OF THE PREFERRED EMBODIMENTS

Figure 1:
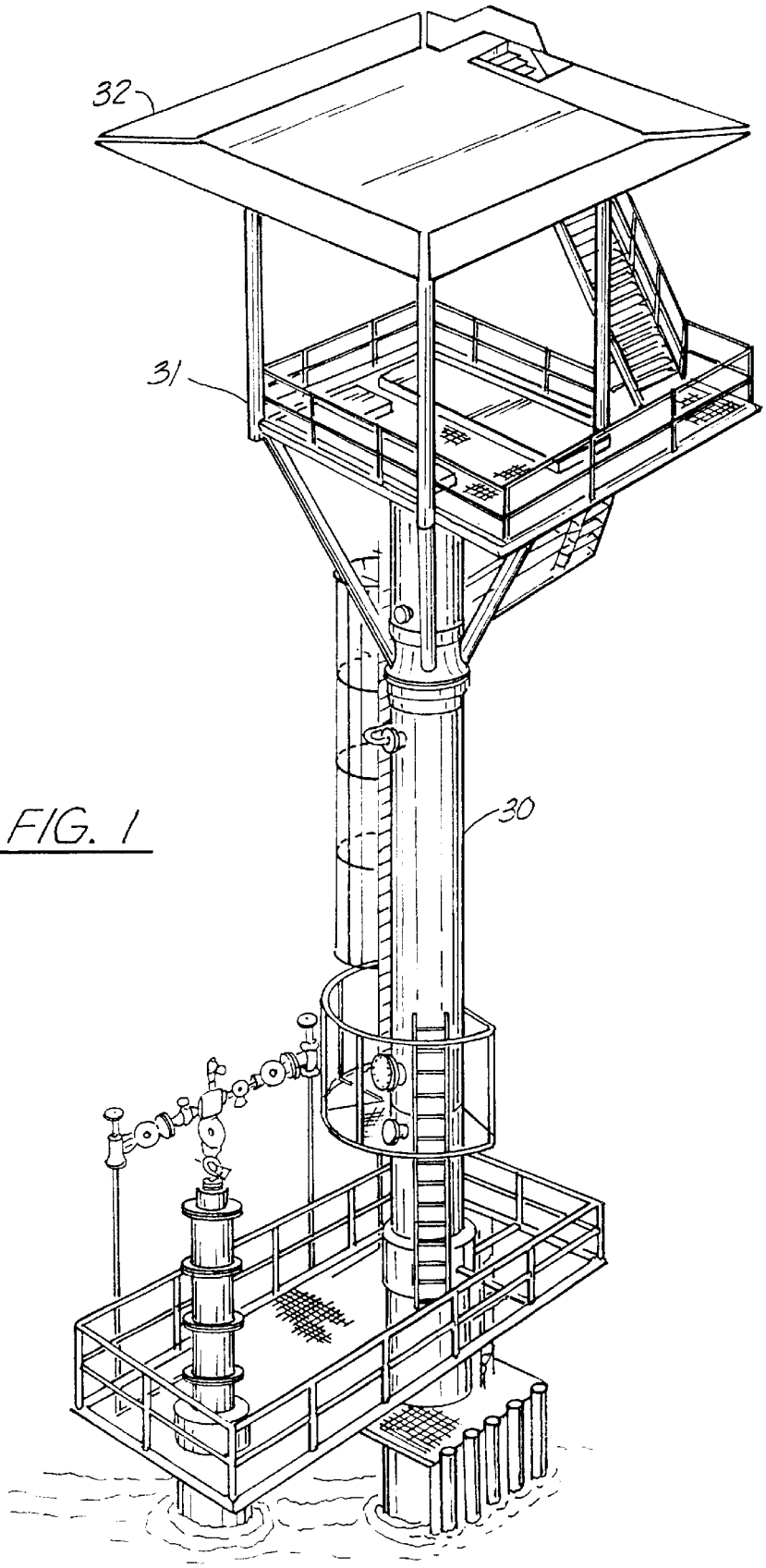
FIG. 1 is a perspective view of a preferred embodiment of the entire Vertical Combined Production Facility installed in accordance with the present invention.

FIG. 1 depicts the chief exterior features of the present invention in a preferred operating environment, in this instance, offshore: the single vessel processing unit 30 which houses all of the processing functions and which is the sole structural support for a service deck 31 and helideck 32.

Figure 2:
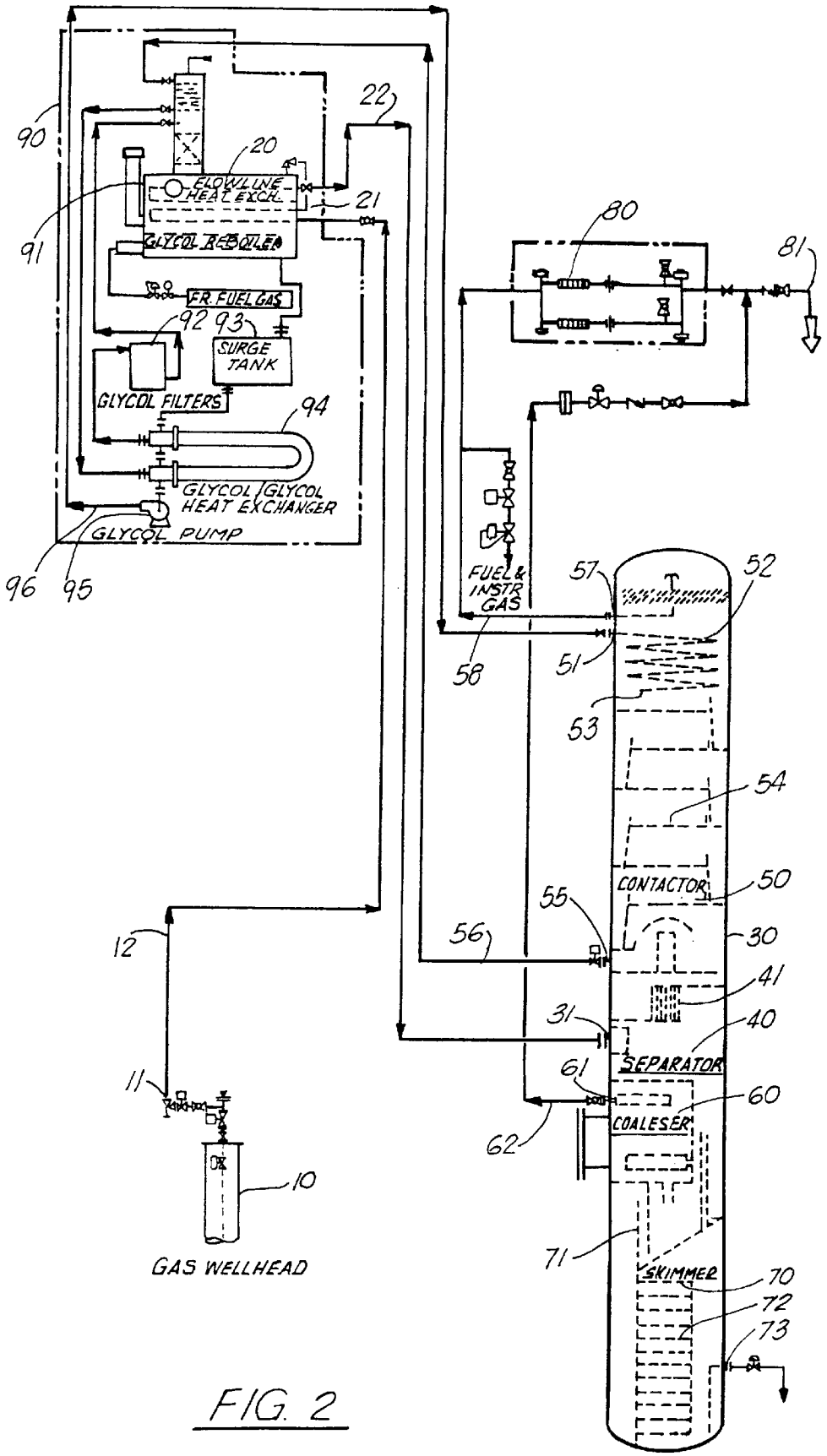
FIG. 2 is a simplified process flow schematic of a preferred embodiment of the invention showing the multiple functions which the invention performs within the single pressure vessel shell. Other items such as the wellhead, glycol regeneration unit, and sales gas meter skid are also shown to fully describe the operation of the Vertical Combined Production Facility.
Figure 3:
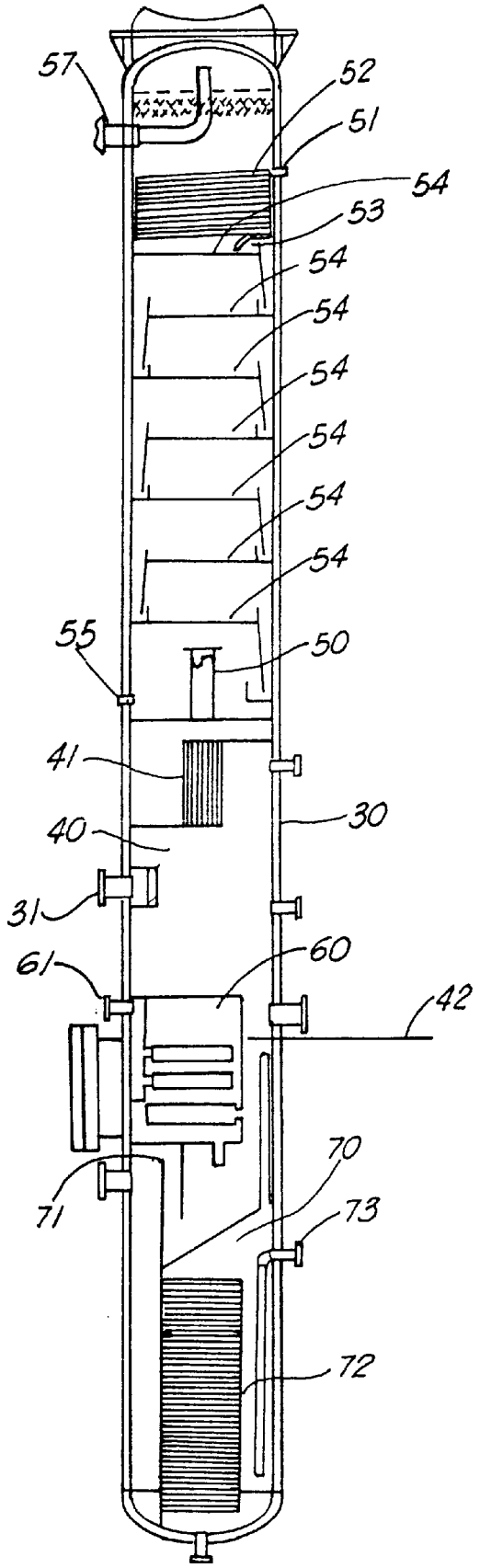
FIG. 3 is a more detailed view of a preferred embodiment showing the internal baffles, compartments, weirs, and items depicted to fully explain the operation and capabilities of the Vertical Combined Production Facility.

Referring now to FIG. 2, the main operating features of the invention are shown schematically: the processing unit 30 and the glycol regeneration unit 90. The glycol regeneration unit is further comprised of a glycol reboiler 91 and a flowline heat exchanger 20 in thermal engagement with the reboiler 91 which transfers heat from the glycol reboiler for the purpose of heating the hydrocarbon mixture. Within the processing unit 30 are the individual processing functions, the combination of which in a single vessel is one aspect of this invention: the separator 40, the contactor 50, the coalescer 60, and the water skimmer 70. In one particularly preferred embodiment, each of these elements are contained within the single vessel processing unit 30. In other embodiments of the invention, each of the above-named elements need not be contained within the vessel processing unit 30; one or more may remain outside the vessel. FIG. 2 is sufficiently detailed to describe the operation of one preferred embodiment of the present invention, which is as follows. A mixture comprising natural gas, produced water and liquid hydrocarbon leaves the wellhead 10 and passes through a choke 11 to slightly reduce the pressure of the hydrocarbon mixture. Thereafter, the mixture travels through a conduit 12 to the flow-line heat exchanger 20. In order for the hydrocarbon mixture to be properly processed, i.e., separated into its three phases—water, liquid hydrocarbon, and natural gas—the mixture must undergo a substantial drop in pressure relative to the pressure at which it initially exits the wellhead. This drop in pressure will cause a consequent drop in the temperature of the mixture. As the temperature of the mixture decreases, the formation of hydrates may occur, which is an undesirable side reaction. Therefore, it is desirable to heat the mixture prior to processing. Consequently, the mixture passes through the flow-line heat exchanger 20. The mixture exits the flow-line heat exchanger, then passes through a choke 21. At this choke, the mixture undergoes a large drop in pressure and a consequential substantial drop in temperature, to achieve the desired pressure. After undergoing the pressure drop at the choke 21, the mixture makes a second pass through the flow-line heat exchanger 20. The flow-line heat exchanger does not have its own heat source in the instant invention. Indeed, one aspect of the instant invention is that the heat source for the flow-line heat exchanger, or the heat source relied upon to heat the mixture prior to processing, is the reboiler 91 which is in thermal engagement with the flow-line heat exchanger and which provides heat to the flow-line heat exchanger to heat the mixture. The combined utilization of the flow-line heat exchanger with the glycol regeneration heat source is a new feature of this invention and entirely eliminates the need for a separate fired device, commonly known as an indirect fired flow-line heater, thereby reducing overall project capital and maintenance costs as well as enhancing safety through the reduction of the number of fired devices in a hazardous environment. The purpose of the reboiler 91 is to regenerate (by heating the desiccant above the boiling point of water to remove the water) the desiccant. The desiccant is relied upon in the instant invention to remove moisture from the natural gas, which takes place in the contactor 50. The desiccant, or the rich desiccant, returns to the reboiler at which point it is heated above the boiling point of water, thereby driving off the water from the desiccant. The lean desiccant is then recycled back into the processing unit 30 to be in contact with the natural gas. The operation of the desiccant reboiler may occur by a variety of means well-known in the industry. In one preferred embodiment of the instant invention, the reboiler is a glycol reboiler (i.e., the particular desiccant employed is glycol), and works in conjunction with glycol filters 92, a surge tank 93, glycol/glycol heat exchanger 94, and a glycol pump 95 and conduit all which make up a regeneration unit 90 for delivering the lean glycol to the contactor 50 located within the processing unit 30.

Returning to the description of the operation of the preferred embodiments of the present invention, after the second pass through the flow-line heat exchanger, the mixture exits the flow-line heat exchanger 20 and is delivered to the processing unit 30 via a second conduit 22 and mixture inlet 31. In the separator 40, the mixture undergoes a separation into two distinct phases: gaseous phase and a liquid phase. The operation of "separators" is well-known in the industry, and the separator of the present invention is not limited to a particular embodiment, but rather incorporates by reference the state-of-the-art separators known to the industry. In one preferred embodiment, the separation is affected by gravity. In this particular embodiment, the liquid which consists of liquid hydrocarbon and produced water sinks downward by virtue of its higher specific gravity relative to the natural gas. Contemporaneously, the natural gas moves upward into and through the vane mist extractor 41. Since the phase consisting of natural gas has a lower specific gravity than the phase consisting of liquid hydrocarbon and produced water, the produced water and liquid hydrocarbon phase move downward, and the natural gas moves upward. The approximate boundary separating the two phases is shown at 42. The overall level of the liquid hydrocarbon is maintained at a constant level by a spill-over weir 71. As the natural gas moves upward within the separation section 40 and through the vane mist extractor 41, it reaches the contactor 50. The technology embodied in the contactor is well-known in the art, and the present invention is not limited to a particular contactor type, but rather incorporates by reference all that is known to the industry. The contactor preferably consists of a series of absorption trays 54. In the contactor, water moisture is removed from the gas stream by contact with lean glycol. Lean glycol enters the contactor section 50 from the glycol regeneration unit shown at 90; the lean glycol is pumped from a glycol pump 95 through a conduit 96 and enters the contactor section 50 through an inlet 51 where it moves through a coil 52 and spills onto the first of several trays which comprise the glycol contactor 50. The uppermost tray is shown at 54. The glycol exits the coil 52 via an outlet shown at 53. From the outlet 53 the glycol is poured onto the trays which comprise the contactor, the trays depicted at 54. The essential steps in the process by which water moisture is removed from the natural gas is as follows: lean glycol moves downward onto subsequent trays where it encounters natural gas which is moving upward. When the natural gas encounters the lean glycol, the latter has a greater affinity for water owing to its greater polarity, therefore it preferentially adsorbs the water from the natural gas. Therefore, as the natural gas moves upward through the contactor it is gradually desiccated. Referring back to FIG. 2, finally, the purified natural gas reaches an outlet 57. From there, the dehydrated natural gas flows through a conduit 58 to a common sales gas meter 80 and departs through a common gas pipeline 81. Contemporaneous with the removal of water from the natural gas and the upward movement of the sequentially dehydrated natural gas, is the consequent downward movement and subsequent hydration of glycol; that is, the glycol becomes "rich." The rich glycol reaches the glycol outlet 55 then returns to the reboiler 91 by a conduit 56. In the reboiler 91 the rich glycol is heated significantly above the boiling point of water, to remove the water from the glycol. This lean glycol is then recirculated back to the processing unit contactor section 50 via the conduit 96 where it enters the inlet 51.

Returning to the processing of the liquid phase in the separator section, the phase consisting of liquid hydrocarbon and produced water moves downward by virtue of its higher specific gravity relative to the gas phase. The phase consisting of the liquid hydrocarbon and produced water moves downward to a coalescing chamber 60. The coalescing chamber may comprise any system or apparatus for removing entrained globules of water dispersed in the liquid hydrocarbon known to the industry. In one preferred embodiment of the present invention, the coalescer is comprised of a series of coalescing and filtering media. The water globules preferentially adhere to the media, which further induces coalescence of the water by cohesion. Hence, in the coalescing chamber, the separation of produced water entrained within the liquid hydrocarbon is enhanced by promoting aggregation of the entrained water globules. The liquid hydrocarbon separated from the produced water moves upward by virtue of a higher specific gravity relative to the produced water and exits the coalescing chamber 60 through an outlet 61 and via a conduit 62 to be transported to market via reinjection into the gas pipeline 81. Next, the produced water, which still has minute amounts of liquid hydrocarbon, and is therefore unsuitable for discharge into the ocean or other ambient environment, must be further polished. Thus, this produced water flows naturally downward where it encounters a polishing means. The further polishing is accomplished, preferably by a water skimmer 70 which enhances the separation capability and efficiency by removing minute droplets of hydrocarbon liquid from the produced water stream. The water skimmer may consist of a series of polyolefinic baffles to significantly reduce the residence time required for separation, thereby allowing more efficient separation. Again, one aspect of this invention is the combination of the central processing functions within a single vessel, hence the relationship between the various functions is emphasized rather than the functions themselves. More particularly, one novel feature of this invention is that no control valve or mixer is required—as it is in the state-of-the-art production facilities—which is typically situated between the separation section 40 and the water skimmer section 70. More particularly, a production facility in which the separator and secondary water polishing system are physically separate, as in most state-of-the-art production facilities, must rely upon a valve to control the flow of hydrocarbon-entrained produced water from one system to the other. This inhibits proper separation of the two phases because the liquid hydrocarbon entrained in the produced water is further dispersed as it passes through the valve. The produced water which is separated from the minute amounts of liquid hydrocarbon flows downward in the water skimmer section by virtue of its higher specific gravity relative to liquid hydrocarbon. The produced water is removed from the water skimmer section 70 through an outlet 73 and discharged into the ambient environment. The liquid hydrocarbon separated from the produced water flows upward by virtue of its lower specific gravity relative to the produced water and enters the separator section 40. At this point the liquid hydrocarbon moves into the coalescer section 60 and ultimately to the sales pipeline with the other hydrocarbon liquids.

It is to be understood that the present invention is by no means limited to the particular constructions herein disclosed and/or shown in the drawings, but also comprises any modifications or equivalents within the scope of the claims.

Having thus described my invention, I claim:

1. A Vertical Combined Production Facility apparatus for processing a hydrocarbon mixture of natural gas, liquid hydrocarbons and produced water, the apparatus comprising:

(i) a separator for receiving a stream of the mixture and separating the mixture into a liquid and a gaseous phase;

(ii) a contactor, fluidly engaged to the separator, for further dehydrating the natural gas utilizing a supply of liquid desiccant;

(iii) a coalescer, in fluid engagement with the separator, wherein the contactor, separator, and coalescer, are contained within a single process vessel;

(iv) a reboiler disposed in fluid communication with the contactor for regenerating liquid desiccant received from the contactor and returning regenerated liquid desiccant to the contactor; and (v) a heat exchanger disposed in fluid communication with the separator, and thermally engaged with the reboiler and such that the heat exchanger preheats a stream of the mixture using heat drawn from the reboiler prior to the mixture being received by the separator.

2. The apparatus of claim 1, wherein the separator, the contactor, and the coalescer are disposed in substantial vertical alignment inside a single vessel.

3. The apparatus of claim 2, wherein the single vessel is adapted to provide primary support for a deck located thereabove.

4. The apparatus of claim 3, wherein the deck includes a helideck.

5. The apparatus of claim 1, further comprising a pressure reducing device for reducing the pressure of the stream of hydrocarbon mixture prior to the stream being received by the heat exchanger.

6. The apparatus of claim 5, wherein the pressure reduction device includes a choke.

7. The apparatus of claim 1, wherein the heat exchanger is a flow-line heat exchanger, and the heat exchanger and reboiler are thermally engaged such that the heat exchanger draws heat directly from the reboiler.

8. The apparatus of claim 1, further comprising, a water polisher, in fluid engagement with the separator, positioned in the vessel to receive produced water from the separator by gravity.

9. A Vertical Combined Production Facility apparatus for processing a hydrocarbon mixture of natural gas, liquid hydrocarbons and produced water, the apparatus comprising:

(i) a liquid organic solvent reboiler;

(ii) a heat exchanger thermally engaged with the reboiler for preheating a stream of the hydrocarbon mixture;

(iii) a separator, which receives a preheated stream of the mixture from the heat exchanger, for separating the mixture into a liquid and a gas phase;

(iv) a contactor, fluidly engaged with the separator, for further dehydrating the natural gas using a liquid organic solvent recirculated through the reboiler for regeneration;

(v) a coalescer, in fluid engagement with the separator;

(vi) a water polisher, in fluid engagement with the separator;

wherein the contactor, separator, coalescer, and water polisher are contained in substantially vertical alignment within a single process vessel, the vessel being adapted to provide support for a deck positioned above the vessel.

10. The apparatus of claim 9 wherein the single vessel can be maintained using a single set of safety devices.

11. The apparatus of claim 9 wherein the liquid organic solvent reboiler is a glycol reboiler.

12. The apparatus of claim 9 wherein the water polisher is comprised of polyolefinic plates situated in parallel.

13. The apparatus of claim 9 wherein the separator is configured to achieve separation of the two phases by means of gravity.

14. The apparatus of claim 9 wherein the vessel is an enclosed pressurized vessel.

15. The apparatus of claim 9 wherein the vessel is adapted to serve as the primary structural support for a helideck.

16. The apparatus of claim 9 wherein the separator further comprises a vane mist extractor.

17. The apparatus of claim 9 wherein the vessel is oriented vertically.

18. The apparatus of claim 9 wherein the apparatus comprises an additional means for removing water moisture from the natural gas.

19. The apparatus of claim 9 wherein the heat exchanger is a flow-line heat exchanger that draws heat directly from the reboiler.

20. The apparatus of claim 9, further comprising:

(i) an inlet pipeline for fluidly communicating an inlet of the heat exchanger with an in situ source of the hydrocarbon;

(ii) a heat exchanger discharge line fluidly communicating an outlet of the heat exchanger with an inlet of the separator;

(iii) a reboiler discharge line for delivering regenerated glycol solvent from the reboiler to the contactor; and (iv) a reboiler inlet line for returning glycol solvent from the contactor to the reboiler.

21. A method of processing a hydrocarbon mixture of natural gas, liquid hydrocarbons and produced water, said method comprising the steps of:

providing a process vessel;

providing a heating unit that includes a heat exchanger and a reboiler disposed in thermal communication with the heat exchanger;

withdrawing a stream of the hydrocarbon mixture from an in situ source;

directing the stream through the heat exchanger to preheat the hydrocarbon mixture, whereby heat is drawn from the reboiler;

directing a stream of the preheated mixture from the heat exchanger to the process vessel;

separating the preheated mixture received in the process vessel into a liquid phase and a gas phase;

dehydrating the natural gas in the gas phase using a supply of liquid desiccant received from the reboiler;

returning liquid desiccant to the reboiler, after the dehydrating step; and operating the reboiler to heat the returned liquid desiccant, thereby regenerating the liquid desiccant.

22. The method of claim 21, wherein the separating step includes, separating the mixture into a liquid phase containing liquid hydrocarbons and produced water, and a gas phase containing natural gas, the method further comprising the step of separating the liquid phase into water and liquid hydrocarbon.

23. The method of claim 22, further comprising, after the step of separating the liquid phase, the steps of:

promoting aggregation of entrained water globules in the liquid hydrocarbon; and removing the entrained globules from the liquid hydrocarbon.

24. The method of claim 23, further comprising, after the step of separating the liquid phase, the steps of promoting aggregation of entrained liquid hydrocarbon globules within the produced water; and removing the entrained liquid hydrocarbon globules from the produced water.

25. The method of claim 24, wherein the process vessel includes a polishing section having a water skimmer, and wherein, after the step of removing the entrained liquid hydrocarbon globules, the method further comprises the steps of:

directing the produced water into the polishing section; and passing the produced water through the water skimmer to further remove liquid hydrocarbon from the produced water.

26. The method of claim 21, wherein the process vessel includes a coalescing section, the method further comprising, after the step of separating the mixture, the step of directing the liquid phase into the coalescing section to separate produced water from liquid hydrocarbon.

27. The method of claim 21, wherein the step of separating the preheated mixture includes separating the mixture into a liquid phase and a gas phase by gravity.

28. The method of claim 21, wherein the step of operating the reboiler includes heating the liquid desiccant above the boiling point of water.

29. The method of claim 28, wherein the process vessel includes a contactor section, and wherein the step of dehydrating the natural gas includes directing the gas phase into the contactor section, and wherein the step of returning liquid desiccant includes returning the regenerated liquid desiccant into the contactor section.

30. The method of claim 29, further comprising the step of:

selecting glycol as the liquid desiccant.

31. The method of claim 21, wherein the process vessel includes a separator for separating the preheated mixture into the liquid phase and the gas phase, a contactor for dehydrating the natural gas in the gas phase using liquid glycol as a liquid desiccant, and a coalescer for separating the liquid phase into water and liquid hydrocarbon, wherein the step of separating the preheated mixture includes passing the mixture through the separator;

wherein the step of separating the liquid phase into water and liquid hydrocarbon includes directing the liquid phase through the coalescer by gravity; and wherein the step of dehydrating the natural gas includes directing the gas phase through the contactor.

32. The method of claim 21, wherein the step of providing a process vessel includes providing the contactor, the coalescer and the separator inside the vessel disposed in substantial vertical alignment therein.

33. The method of claim 32, wherein the separator is positioned intermediate the contactor and the coalescer, such that the liquid phase and the produced water move substantially downward by gravity therethrough and wherein the gas phase moves substantially upward.

34. The method of claim 33, wherein the process vessel further includes a water skimmer having a plurality of polyolefinic plates situated in parallel relation, and wherein the step of separating the liquid phase includes directing the liquid phase downward through the plurality of polyolefinic plates.

35. The method of claim 21, wherein the heat exchanger is a flow-line heat exchanger, and the step of directing the stream through the heat exchanger includes drawing heat directly from the reboiler.

36. The method of claim 21, further comprising the step of directing the stream of hydrocarbon mixture through a choke to substantially reduce the pressure of the stream, prior to the step of directing the stream through the heat exchanger.

37. An apparatus for processing a hydrocarbon mixture of natural gas, liquid hydrocarbon and produced water, the apparatus comprising:

a heating system including a reboiler for heating a liquid desiccant passed therethrough in order to regenerate the liquid desiccant and a heat exchanger disposed in substantial thermal communication with the reboiler such that the heat exchanger draws heat from the reboiler, the heat exchanger being disposed in fluid communication with a source of the liquid hydrocarbon mixture in order to preheat the mixture; and a process vessel containing, in substantial vertical alignment therein, a separator disposed in fluid communication with the heat exchanger to receive a stream of the preheated mixture, the separator being adapted to separate the preheated mixture into a liquid phase and a gas phase, a contactor disposed in fluid communication with the separator, and having an inlet for receiving liquid desiccant from the reboiler, and an outlet for returning liquid desiccant to the reboiler after the liquid desiccant is used to dehydrate natural gas in the gas phase received from the separator; and a coalescer disposed in fluid communication with the separator for receiving the liquid phase and separating water from liquid hydrocarbon in the liquid phase; and a pressure reducing device for reducing the pressure of a stream of the hydrocarbon mixture prior to the stream being received by the heat exchanger.

38. The apparatus of claim 37, wherein the process vessel further contains a water skimmer section downstream of the coalescer for further polishing produced water received from the coalescer.

39. The apparatus of claim 38, wherein the water skimmer includes a plurality of polyolefinic plates situated in parallel relation.

40. The apparatus of claim 37, wherein the reboiler is a liquid glycol reboiler, the apparatus further comprising a recirculation pipeline interconnecting the contactor with the reboiler such that liquid glycol can be circulated between the reboiler and the contactor.

41. The apparatus of claim 37, wherein the contactor includes a plurality of contactor trays whereon liquid desiccant can engage the gas phase to remove moisture therefrom.

42. The apparatus of claim 37, wherein the separator is adapted to achieve separation of the mixture by gravity.

43. The apparatus of claim 42, wherein the separator includes a vane mist extractor.

44. The apparatus of claim 37, wherein the separator is disposed intermediate the contactor and the coalescer in the process vessel, such that the liquid phase moves downward by gravity from the separator through the coalescer, and the gas phase moves upward from the separator through the contactor.

45. The apparatus of claim 37, wherein the process vessel is an enclosed pressurized vessel.

46. The apparatus of claim 37, wherein the process vessel is adapted to provide primary structural support for a deck.

47. The apparatus of claim 37, wherein the deck includes a helideck.

48. The apparatus of claim 37, further comprising:

a heat exchanger inlet conduit fluidly communicating an inlet of the heat exchanger with a choke of the pressure reducing device;

a heat exchanger discharge conduit, fluidly communicating an outlet of the heat exchanger with an inlet of the separator, for delivering a preheated mixture thereto;

a reboiler discharge conduit, fluidly communicating an outlet of the reboiler with an inlet of the contactor, for delivering regenerated liquid desiccant thereto; and a contactor discharge conduit, fluidly communicating an outlet of the contactor with an inlet of the reboiler, for delivering moisture-enriched liquid desiccant thereto.

49. An apparatus for processing a hydrocarbon mixture of natural gas, liquid hydrocarbons and produced water, the apparatus comprising:

a reboiler for heating a liquid desiccant passed therethrough in order to regenerate the liquid desiccant;

a pressure reducing device for reducing the pressure of a stream of the hydrocarbon mixture passed therethrough;

a heat exchanger disposed in substantial thermal communication with the reboiler such that the heat exchanger draws heat directly from the reboiler to preheat a stream of the hydrocarbon mixture that is passed therethrough, the heat exchanger having an inlet disposed in fluid communication with an outlet of the pressure reducing device;

an elongated, vertically-oriented vessel containing a separator disposed in fluid communication with the heat exchanger to receive a stream of the preheated mixture therefrom, the separator being adapted to separate, by gravity, the preheated mixture into a liquid phase and a gas phase and include a vane mist extractor, a contactor disposed in fluid communication with the separator to receive the gas phase therefrom, the contactor having a plurality of contactor trays disposed substantially above the separator, whereon liquid desiccant operates to dehydrate natural gas in the gas phase, an inlet for receiving regenerated liquid desiccant from the reboiler, and an outlet for returning liquid desiccant to the reboiler, a coalescer disposed substantially below the separator for receiving the liquid phase and separating water from liquid hydrocarbon in the liquid phases; and a water skimmer section disposed substantially below the coalescer for further polishing produced water received from the coalescer, the water skimmer including plurality of polyolefinic plates situated in parallel relation.

50. The apparatus of claim 49, wherein the vessel is an enclosed pressure vessel adapted to provide primary structural support for a helideck located thereabove.

51. The apparatus of claim 50, wherein the liquid desiccant is liquid glycol and the reboiler is a liquid glycol reboiler.

* * * * *